US006355876B1

(12) United States Patent
Morimoto

(10) Patent No.: US 6,355,876 B1
(45) Date of Patent: Mar. 12, 2002

(54) TWISTED-PAIR CABLE AND METHOD OF MAKING A TWISTED-PAIR CABLE

(75) Inventor: Nobuhiro Morimoto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/669,755

(22) Filed: Sep. 26, 2000

(30) Foreign Application Priority Data

Sep. 27, 1999 (JP) ..... 11-272574

(51) Int. Cl.[7] ..... H01B 11/02
(52) U.S. Cl. ..... 174/27; 174/113 R
(58) Field of Search ..... 174/27, 113 R

(56) References Cited

U.S. PATENT DOCUMENTS

| | | | | |
|---|---|---|---|---|
| 5,298,680 A | | 3/1994 | Kenny | 174/36 |
| 5,576,515 A | | 11/1996 | Bleich et al. | |
| 5,600,097 A | * | 2/1997 | Bleich et al. | 174/113 R X |
| 5,739,473 A | * | 4/1998 | Zerbs | 174/121 A |
| 5,789,711 A | | 8/1998 | Gaeris et al. | |
| 5,814,768 A | | 9/1998 | Wessels et al. | |
| 5,932,847 A | | 8/1999 | Mayfield | |
| 5,952,607 A | * | 9/1999 | Friensen et al. | 174/27 X |
| 5,969,295 A | | 10/1999 | Boucino et al. | |

FOREIGN PATENT DOCUMENTS

| | | |
|---|---|---|
| DE | 19636286 | 3/1998 |
| EP | 0828259 | 3/1998 |
| JP | 11-53958 | 2/1999 |

OTHER PUBLICATIONS

English Language Abstract of JP 11–53958.
English Language Abstract of EP 0828259.
English Language Abstract of DE 19636286.

* cited by examiner

*Primary Examiner*—Chau N. Nguyen
(74) *Attorney, Agent, or Firm*—Greenblum & Bernstein, P.L.C.

(57) ABSTRACT

There is provided a twisted-pair cable having a good anti-voice leak quality and handling facility, and a method of making the twisted-pair cable. Thus, the end-conditioning process of such a cable is rendered easier, and the cable can be produced at a lower cost. The twisted-pair cable includes a pair of twisted-pair core wires respectively including a pair of insulated core wires, each of which has an electrical conductor and an insulator layer coated thereon. The twisted-pair cable further includes a core cable assembly formed by twisting a pair of unitary core wire complexes, each of which is formed by twisting the pair of twisted-pair core wires.

7 Claims, 3 Drawing Sheets

TWISTED-PAIR CABLE AND METHOD OF MAKING A TWISTED-PAIR CABLE

BACKGROUND OF THE INVENTION

1. Field of the Invention

The present invention relates to twisted-pair cables used, for instance, in LAN (local area network) systems. The use of twisted-pair cables in a LAN system is principally motivated by their economical advantage in comparison to other types of cables. Moreover, the twisted-pair cables have the additional advantage of being easy to handle.

2. Description of Related Art

A twisted-pair cable 50, shown e.g. in FIG. 1, is manufactured by the successive steps of: coating a conductor portion 51 with an insulator coating 52, thereby forming an insulated core wire 53; twisting two of the insulated core wires 53 to produce a twisted-pair core wire 54; assembling four twisted-pair core wires 54 to produce a core cable assembly 55; and finally coating the core cable assembly 55 with a cable coating 56.

Recently, the transmission speed in LAN systems has increased tremendously. Taking this progress into account, a transmission speed of 250 MHZ has now been prescribed, for example, in the specification defined in Category 6 of EIA (Electronic Industries Association) and TIA (Telecommunications Industry Association) in the United States.

Consequently, the twisted-pair cables 50 used in LAN systems must also satisfy the requirements for such high transmission characteristics. In particular, voice (or conversation) leakage (or crosstalk) at a high-transmission speed must be lowered to minimum.

In the twisted-pair cable 50 shown in FIG. 1, the four units of twisted-pair core wire 54 are further referred to as ①, ②, ③ and ④, respectively. When such a twisted-pair cable 50 is considered, six combinations of twisted-pair core wires 54 are conceivable as a cause for voice or conversation leakage. These combinations are ①/②, ①/③, ①/④, ②/③, ②/④ and ③/④. Among these combinations, each of four combinations: ①/②, ①/④, ②/③ and ③/④ includes two twisted-pair core wires 54 which are adjacent to each other over their length and assembled in the circumferential direction in the twisted-pair cable 50. In these combinations, the two twisted-pair core wires 54 are constantly in contact over their length. They therefore tend to generate voice leakage, and cause deterioration in the sound quality of the conversation in the twisted-pair cable 50.

Even in the other combinations, i.e., ①/③, and ②/④, the cross-section of a twisted-pair core wire 54 does not form a proper circle, as such a twisted-pair core wire 54 is formed by twisting the insulated core wires 53. Accordingly, the shape shown in FIG. 1 tends to be distorted. As a result, the twisted-pair core wires 54 may be occasionally brought closer to each other, or even put into contact, in certain portions along the length of the cable 50. In such portions, the twisted-pair core wires 54 may be subjected to states alternating between contact and separation.

In order to diminish voice leakage, attempts have been made to coat each twisted-pair core wire 54 with an insulator layer or, as described in patent document JP-A-11-53958, to interpose a spacer having a cross-shaped section between pair of twisted-pair core wires 54.

However, when such known measures are relied upon, the insulator coatings or the use of spacers increase material costs and call for more process steps. Manufacturing costs of the twisted-pair cables are thus inevitably increased.

Moreover, when these coatings and spacers are added into the twisted-pair cables, the cables become thicker and stiffer, and their handling becomes more awkward.

Further, when cable ends are to be conditioned, the coatings and spacers must be removed beforehand. The end-conditioning process thus becomes less efficient.

Thus, some objective of the present invention are to solve such problems, and to provide a low-cost twisted-pair cable which reduces voice leakage, facilitates the handling process and eases the task of cable end conditioning process.

SUMMARY OF THE INVENTION

To this end, there is provided a twisted-pair cable including a pair of twisted-pair core wires respectively including a pair of insulated core wires, each of which includes an electrical conductor and an insulator layer coated thereon. According to one aspect of the present invention, the twisted-pair cable includes a core cable assembly formed by twisting a pair of unitary core wire complexes, each of which is formed by twisting the pair of twisted-pair core wires.

Preferably, the pair of twisted-pair core wires has a respective twist pitch. The twist pitches for each of the twisted-pair core wires contained in the same unitary core wire complex are then arranged such as to yield a unit turn number difference of at least 30 turns/m.

Further, the twist pitches for each of the twisted-pair core wires contained in different unitary core wire complexes may also be arranged such as to yield a unit turn number difference of at least 15 turns/m.

Preferably yet, the pair of unitary core wire complexes has a respective twist pitch, and the twist pitches for each of the unitary core wire complexes are arranged such as to yield a unit turn number difference of at least 15 turns/m.

According to another aspect of the invention, a method of making a twisted-pair cable is provided that includes twisting two pair of insulated core wires to form first and second pairs of twisted-core wires, twisting the first and second pairs of twisted-core wires to form a core wire complex, and twisting a pair of the core wire complexes to form a core cable assembly.

In another aspect of the present invention, the method of making a twisted-pair cable may also include performing the twisting of the two pair of wires by twisting the first pair of twisted core wires at a first twist pitch and twisting the second pair of twisted pitch wires at a second pitch different from the first twist pitch.

Other aspects of the method of making a twisted-pair cable of the present invention include configuring the first and second pitches to result in a unit turn of the respective twist pitches for the twisted-pair core wires contained in different core wire complexes to yield a unit turn number difference of at least 15 turns/m; or providing each of the core wire complexes with a respective twist pitch, and configuring both of the respective twist pitches for the core wire complexes to yield a unit turn number difference of at least 15 turns/m.

In still another aspect of the present invention, the method of making a twisted-pair cable may further include surrounding the core cable assembly with an outer insulating layer.

BRIEF DESCRIPTION OF THE DRAWING

The above and other objects, features and advantages of the present invention will be made apparent from the following description of the preferred embodiments, given as non-limiting examples, with reference to the accompanying drawings, in which.

DESCRIPTION OF THE PREFERRED EMBODIMENTS

Figure 2:
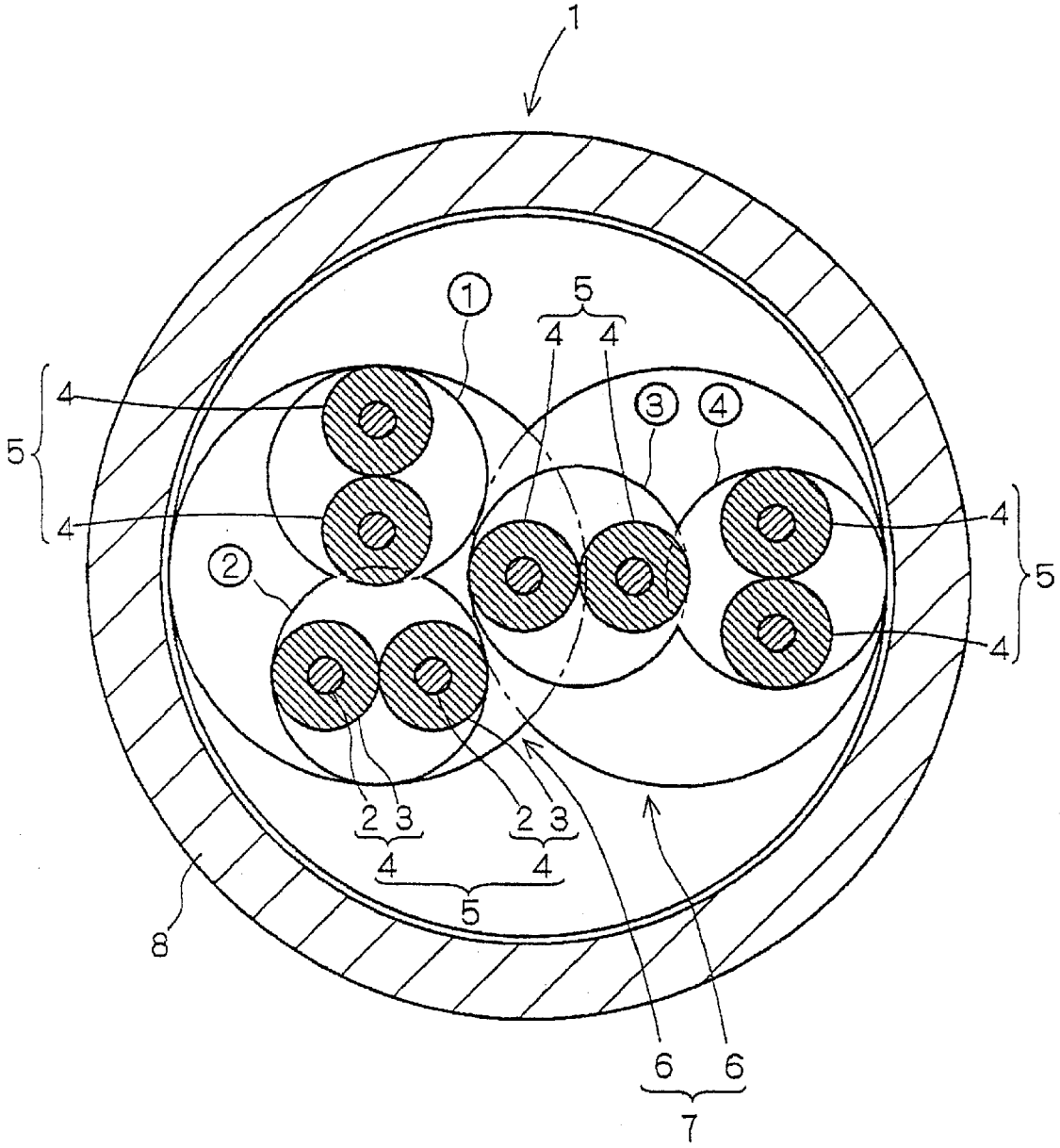
FIG. 2 is a cross-sectional view of a twisted-pair cable according to an embodiment of the present invention.

As shown in FIG. 2, a twisted-pair cable 1 is manufactured by:

- preparing a wire-like conductor 2 made of e.g. a copper alloy;
- surrounding that conductor with an insulator coating 3, whereby an insulated core wire 4 is formed;
- twisting together two such insulated core wires 4 at a given twist pitch, so that a twisted-pair core wire 5 is formed;
- twisting two such twisted-pair core wires 5 at a given twist pitch, thereby producing a unitary core wire complex 6;
- twisting two such unitary core wire complexes 6 at a given twist pitch, thereby forming a core cable assembly 7; and
- surrounding the core cable assembly 7 with an outer coating 8 made of insulator resin.

The twisted-pair cable 1 thus formed exhibits a low voice (or conversation) leakage, for the reasons mentioned below.

In FIG. 2, two twisted-pair core wires 5 in one of the unitary core wire complexes 6 are referred to as ① and ②, respectively, while two twisted-pair core wires 5 in the other unitary core wire complex 6 are referred to as ③ and ④, respectively.

The above twisted-pair cable 1 includes, as in the prior art, 4 twisted-pair core wires 5 forming six combinations (①/②, ①/③, ①/④, ②/③, ②/④ and ③/④). Among them, only the combinations formed inside the same unitary core wire complex 6, i.e. combinations ①/② and ③/④ form a condition in which two twisted-pair core wires 5 are constantly in contact with each other over the length of the twisted-pair cable 1.

Further, a first unitary core wire complex 6 containing combination ①/②, and a second unitary core wire complex 6 containing combination ③/④ are prepared respectively by intertwining corresponding twisted-pair core wires 5. Accordingly, in the first unitary core wire complex 6, the positions of two twisted-pair core wires 5 in combination ①/② alternate along the length of the twisted-pair cable 1. Likewise, in the second unitary core wire complex 6, the positions of two twisted-pair core wires 5 in combination ③/④ alternate along the length of the cable 1. Consequently, the relative positions of the two twisted-pair core wires 5 are varied in both cases. Furthermore, in the other combinations ①/③, ①/④, ②/③ and ②/④ too, the corresponding twisted-pair core wires 5 in each combination are alternatingly joined or separated, over the length of the twisted-pair cable 1. As a result, in these combinations too, two corresponding twisted-pair core wires 5 are not in constant contact with each other over the cable's length.

Figure 1:
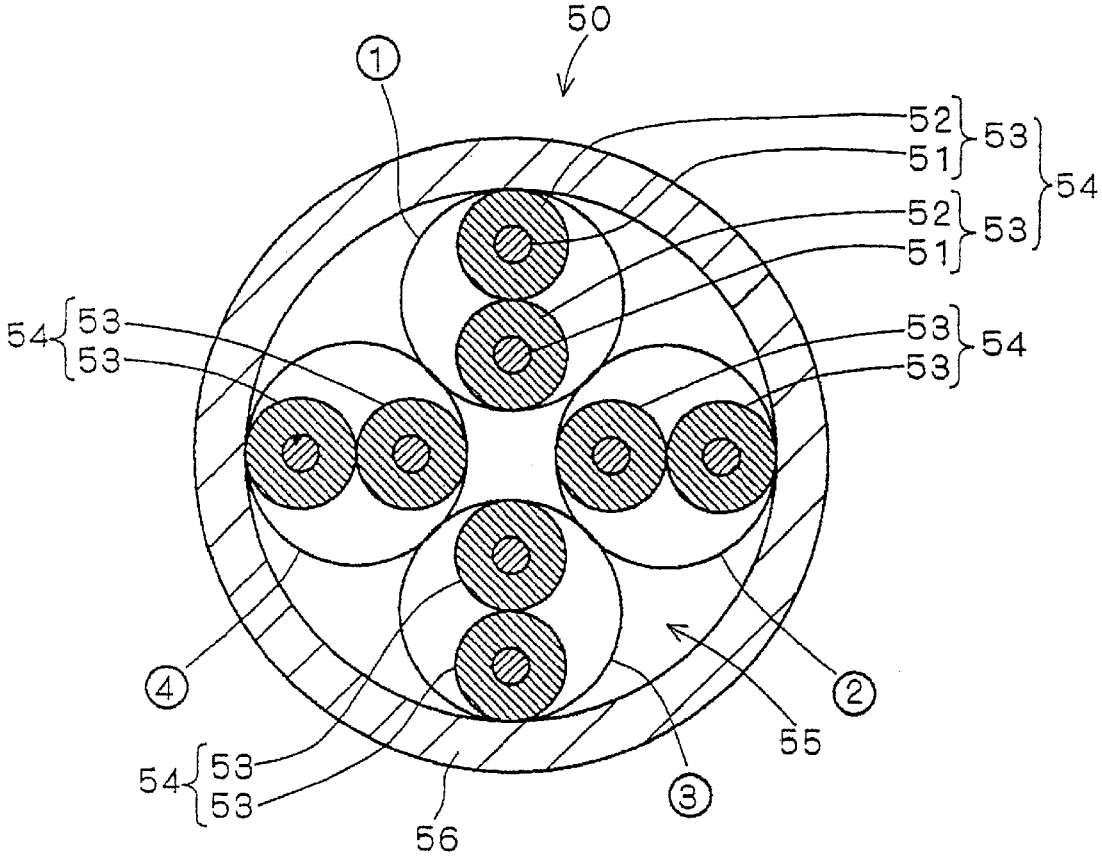
FIG.1 PRIOR ART
FIG. 1 is a cross-sectional view of a known twisted-pair cable, when its constituent twisted-pair core wires are not distorted.

In the prior art twisted-pair cable 50 shown in FIG. 1, two twisted-pair core wires 54 in each of the four combinations ①/②, ①/④, ②/③ and ③/④ are constantly in contact with each other over the length of the cable 50, while two twisted-pair core wires 54 in each of the two combinations ①/③ and ②/④ are alternatingly brought together or separated over the length of the cable 50 (not shown in FIG. 1).

By comparison, in the inventive twisted-pair cable 1, only the twisted-pair core wires 5 in each of two combinations ①/② and ③/④ are constantly in contact with each other over the length of the cable 1, while the twisted-pair core wires 5 in each of the other combinations ①/③, ①/④, ②/③ and ②/④ are alternatingly brought together or separated, over the length thereof.

As a result, the twisted-pair core wires 54 of combinations ①/④ and ②/③, which are constantly in contact with each other according to the prior art configuration, have now been transformed, by the inventive cable configuration, into combinations which alternate between a contact condition and separated condition over the length of the cable. When the two twisted-pair core wires 5 are separated from each other, the voice leakage falls to a lesser degree. Consequently, the inventive twisted-pair cable 1 decreases voice leakage, even in a transmission speed region of 1 to 250 MHZ.

Further, the inventive twisted-pair cable 1 does not require additional parts e.g. a shield layer or spacer, in order to improve its anti-leakage quality. It can therefore be produced at low costs. At the same time, the twisted-pair cable 1 can be made thinner and more flexible, so that its handling becomes easier. Moreover, the end-conditioning process of the twisted-pair cable 1 relieves the burden of removing a shield layer or spacer.

In each of the same unitary core wire complexes 6 of the above twisted-pair cable 1 (combination ①/② or ③/④ where the twisted-pair core wires 5 are constantly in contact over the length of the cable 1, though their positions are alternated), differences in unit turn number between the twisted-pair core wires 5 are preferably set to equal to or over 30 turns/m.

Likewise, the differences in unit turn number between the twisted-pair core wires 5 respectively belonging to different unitary core wire complexes 6 (combinations ①/③, ①/④, ②/③ and ②/④ where the twisted-pair core wires 5 vary between contact condition and separated condition) are preferably set to be equal to or over 15 turns/m. The above differences in unit turn number are defined as follows:

Difference in unit turn number$=(1/P_1-1/P_2)\times 1{,}000$ (turns/m) in which $P_1$ (mm) signifies a twist pitch of one of the twisted-pair core wires 5; and $P_2$ (mm) signifies a twist pitch of the other twisted-pair core wire 5, where $P_1 \leqq P_2$.

The minimum value for the difference in unit turn number is calculated as follows.

Figure 3:
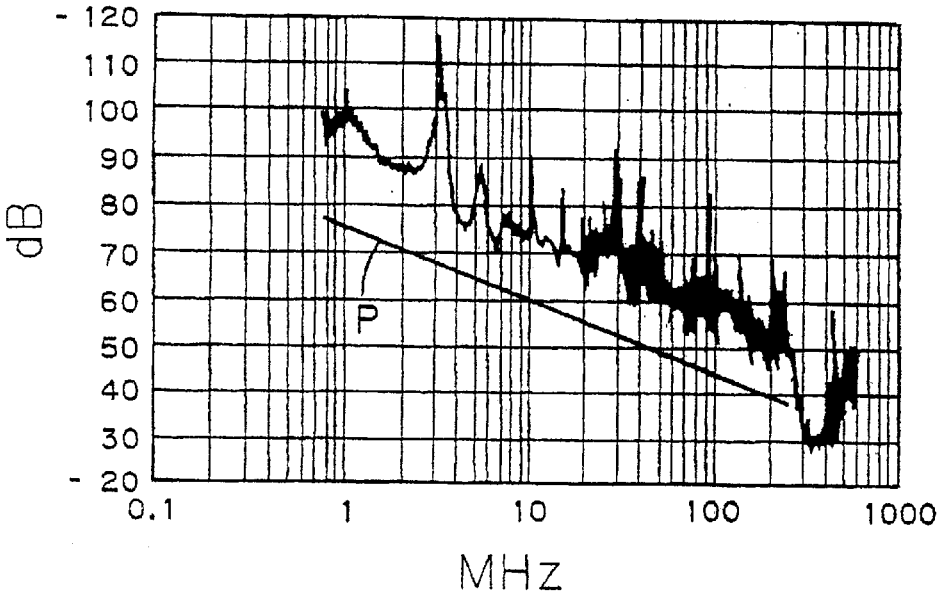
FIG. 3 is a graphic representation of near-end voice leakage attenuation characteristics (ordinate: near-end voice leakage attenuation volumes, abscissa: frequencies), when the unit turn number difference for the twisted-pair core wires in constant contact is at least 30 turns/m.
Figure 4:
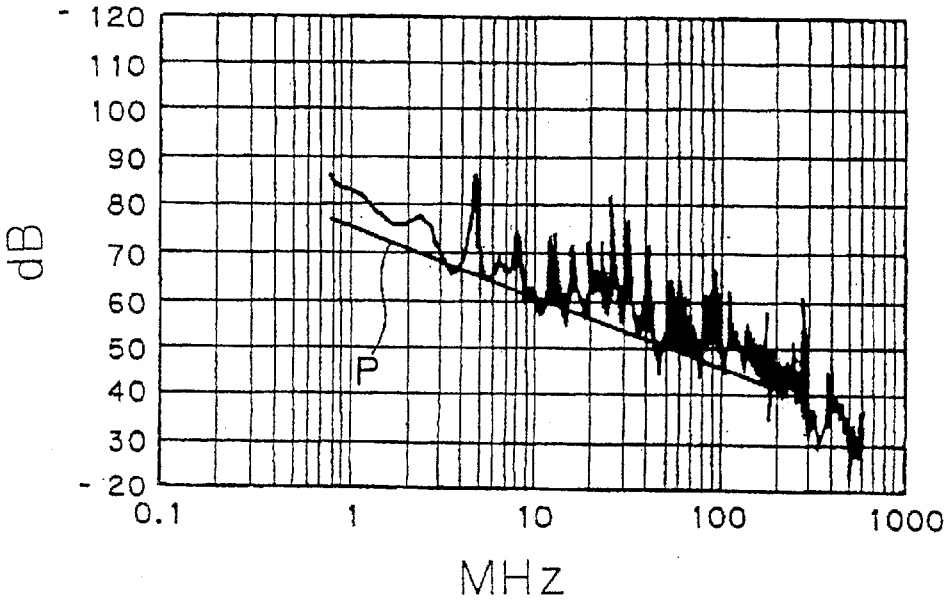
FIG. 4 is a graphic representation of near-end voice leakage attenuation characteristics (ordinate: near-end voice leakage attenuation volumes, abscissa: frequencies), when the unit turn number difference for the twisted-pair core wires in constant contact is at least 15 turns/m.

FIGS. 3 and 4 show a near-end voice leak attenuation volume curve of a twisted-pair cable 50 of FIG. 1, when the twist pitches (and the unit turn number calculated therefrom) are differentiated between the twisted-pair core wires 54 in combinations ①/②, ①/④, ②/③ and ③/④, where the twisted-pair core wires 54 are constantly in contact with each other over the length of the cable 50. FIG. 3 shows the results obtained from such a constantly joined combination, when the twist pitch of the twisted-pair core wires 54 of one component, e.g. ①, of combination ①/②, is set to 10.5 mm, while that of the other component ② is set to 15.5 mm, so that the difference in unit turn number amounts to 30.7 turn/m. FIG. 4 shows the results when the twist pitch of the twisted-pair core wires 54 of one component e.g. ① is set to 10.5 mm, while that of the other component ② is set to 12.5 mm, so that the difference in unit turn number equals to 15.2 turn/m. Line P in FIGS. 3 and 4 represents the near-end voice leak attenuation feature required by Category 6, supra.

As shown in FIGS. 3 and 4, the cable 50 exhibits a good attenuation behavior satisfying the criteria of Category 6 in the region of 1 to 250 MHZ, when the difference in unit turn number is at least 30 turns/m. However, when the difference in unit turn number is around 15 turns/m, the cable 50 does not satisfy the criteria of Category 6.

The inventive twisted-pair cable 1 includes the constantly joined combinations ①/② and ③/④. It can therefore be expected that the difference in unit turn number between the twisted-pair core wire 5 of component ① and that of component ② should be at least 30 turns/m.

On the other hand, combinations ①/③, ①/④, ②/③ and ②/④, where the twisted-pair core wires 5 vary between contact condition and separated condition, give better voice-leak attenuation features, compared to the above-mentioned constantly joined combinations ①/② and ③/④. In this case, it is not necessary to set the difference in unit turn number to such a high level as 30 turns/m. Moreover, when the difference is too large, transmission distances for signals become altered between the corresponding twisted-pair core wires 5 in each combination. This may incur communications errors.

For the above reasons, the minimum difference in unit turn number is preferably set to at least 15 turns/m, which is smaller than in the case of the constantly joined combinations.

The difference in unit turn number is also defined for the unitary core wire complexes 6 on the same principle as for the twisted-pair core wires 5. This difference is preferably set to at least 15 turns/m.

A twisted-pair cable 1 satisfying such requirements may be prepared by implementing the following process steps:

- setting the twist pitch of the twisted-pair core wire 5 of component ① to 9.0 mm;
- setting the twist pitch of the twisted-pair core wire 5 of component ② to 12.5 mm;
- setting the twist pitch of the unitary core wire complex 6, which includes the twisted-pair core wire 5 of component ① and that of component ② to 30 mm;
- setting the twist pitch of the twisted-pair core wire 5 of component ③ to 10.5 mm;
- setting the twist pitch of the twisted-pair core wire 5 of component ④ to 15.5 mm; and
- setting the twist pitch of the unitary core wire complex 6, which includes the twisted-pair core wire 5 of component ③ and that of component ④, to 55 mm.

As mentioned above in detail, the twisted-pair cable according to the invention includes a pair of twisted-pair core wires respectively including a pair of insulated core wires, each of which includes an electrical conductor and an insulator layer coated thereon. The twisted-pair cable further includes a core cable assembly formed by twisting a pair of unitary core wire complexes, each of which is formed by twisting the pair of twisted-pair core wires.

Accordingly, it is only in the same unitary core wire complexes that one of the twisted-pair core wires is constantly in contact with the other over the length of the cable. By comparison, between different unitary core wire complexes, the corresponding twisted-pair core wires are alternatingly brought together with, or led away from, each other over the length of the cable. This has the result of reducing the number of combinations in which one of the twisted-pair core wires is in constant contact with the other over the length of the cable. This means that the combinations of twisted-pair core wires tending to incur voice leak is reduced, thus improving the anti-leak quality of the twisted-pair cable.

When the above configuration is implemented in a twisted-pair cable, the cable's anti-leak qualities can be improved without using shield layers or interposing spacers. The twisted-pair cable can thus be manufactured at a lower cost. Moreover, the twisted-pair cable produced is thinner and more flexible, so that its handling becomes easier. In addition, the above configuration obviates the process of removing shield layers or spacers, so simplifying the end-conditioning of the cable.

Further, in the above configuration, the pair of twisted-pair core wires may have a respective twist pitch and the twist pitches for each of the twisted-pair core wires contained in the same unitary core wire complex may be arranged, such as to yield a difference of at least 30 turns/m in unit turn number.

In combination with, or apart from, the above unit turn number arrangement, the pair of twisted-pair core wires may have a respective twist pitch and the twist pitches for each of the twisted-pair core wires contained in different unitary core wire complexes may be arranged such as to yield a unit turn number difference of at least 15 turns/m. The anti-leak characteristics of the twisted-pair cables are then greatly improved.

Although the invention has been described with reference to particular means, materials and embodiments, it is to be understood that the invention is not limited to the particulars disclosed and extends to all equivalents within the scope of the claims.

The present disclosure relates to subject matter contained in priority Japanese Application No. HEI 11-272574, filed on Sep. 27, 1999.

What is claimed:

1. A twisted-pair cable comprising a pair of twisted-pair core wires, each twisted-pair core wire respectively including a pair of insulated core wires, each of which includes an electrical conductor and an insulator layer coated thereon, said twisted-pair cable comprising a core cable assembly formed by twisting a pair of unitary core wire complexes, each of said unitary core wire complexes being formed by twisting said pair of twisted-pair core wires, wherein said each pair of twisted-pair core wires has a respective twist pitch, and both of said respective twist pitches for said twisted-pair core wires contained in different unitary core wire complexes are configured to yield a unit turn number difference of at least 15 turns/m.

2. The twisted-pair cable according to claim 1, wherein said each pair of unitary core wire complexes has a respective twist pitch, and both of said respective twist pitches for said unitary core wire complexes are configured to yield a unit turn number difference of at least 15 turns/m.

3. A twisted-pair cable comprising a pair of twisted-pair core wires, each twisted-pair core wire respectively including a pair of insulated core wires, each of which includes an electrical conductor and an insulator layer coated thereon, said twisted-pair cable comprising a core cable assembly formed by twisting a pair of unitary core wire complexes, each of said unitary core wire complexes being formed by twisting said pair of twisted-pair core wires, wherein said each pair of twisted-pair core wires has a respective twist pitch, and both of said respective twist pitches for said twisted-pair core wires contained in a same unitary core wire complex are configured to yield a unit turn number difference of at least 30 turns/m, and wherein said each pair of twisted-pair core wires has a respective twist pitch, and both of said respective twist pitches for said twisted-pair core wires contained in different unitary core wire complexes are configured to yield a unit turn number difference of at least 15 turns/m.

4. The twisted-pair cable according to claim 3, wherein said each pair of unitary core wire complexes has a respective twist pitch, and both of said respective twist pitches for said unitary core wire complexes are configured to yield a unit turn number difference of at least 15 turns/m.

5. A method of making a twisted-pair cable, comprising:

twisting two pair of insulated core wires to form first and second pairs of twisted-core wires;

twisting said first and second pairs of twisted-core wires to form a core wire complex; and twisting a pair of said core wire complexes to form a core cable assembly, wherein respective twist pitches for said twisted-pair core wires contained in different core wire complexes are configured to yield a unit turn number difference of at least 15 turns/m.

6. The method of making a twisted-pair cable according to claim 5, further comprising surrounding said core cable assembly with an outer insulating layer.

7. A method of making a twisted-pair cable, comprising:

twisting two pair of insulated core wires to form first and second pairs of twisted-core wires;

twisting said first and second pairs of twisted-core wires to form a core wire complex; and twisting a pair of said core wire complexes to form a core cable assembly, wherein said twisting of said two pair of wires is performed by twisting said first pair of twisted core wires at a first twist pitch and twisting said second pair of twisted pitch wires at a second pitch different from said first twist pitch, said first and second pitches are configured to result in a unit turn number difference of at least 30 turns/m in the core cable assembly, and wherein said each pair of twisted-pair core wires has a different twist pitch, and both of said different twist pitches for said twisted-pair core wires contained in different said core wire complexes are configured to yield a unit turn number difference of at least 15 turns/m.

* * * * *